US007382865B2

(12) United States Patent
Deutscher et al.

(10) Patent No.: US 7,382,865 B2
(45) Date of Patent: Jun. 3, 2008

(54) LEAKAGE RADIATION SHIELDING ARRANGEMENT FOR A ROTARY PISTON X-RAY RADIATOR

(75) Inventors: Thomas Deutscher, Lauf-Simonshofen (DE); Wolfgang Kutschera, Aurachtal (DE); Matthias Seufert, Pettstadt (DE)

(73) Assignee: Siemens Aktiengesellschaft, Munich (DE)

( * ) Notice: Subject to any disclaimer, the term of this patent is extended or adjusted under 35 U.S.C. 154(b) by 159 days.

(21) Appl. No.: 11/283,431

(22) Filed: Nov. 18, 2005

(65) Prior Publication Data

US 2006/0146985 A1 Jul. 6, 2006

(30) Foreign Application Priority Data

Nov. 19, 2004 (DE) ..... 10 2004 056 110

(51) Int. Cl.
*H01J 35/10* (2006.01)

(52) U.S. Cl. ..... 378/144; 378/137; 378/203

(58) Field of Classification Search ..... 378/137, 378/144, 203
See application file for complete search history.

(56) References Cited

U.S. PATENT DOCUMENTS 4,007,376 A * 2/1977 Zimmerman ..... 378/98.6
4,234,794 A * 11/1980 Voinea et al. ..... 378/12
4,788,705 A * 11/1988 Anderson ..... 378/121
5,384,820 A * 1/1995 Burke ..... 378/135
5,703,926 A 12/1997 Bischof
6,084,942 A * 7/2000 Hell et al. ..... 378/200
6,364,527 B1 4/2002 Kutschera
6,426,998 B1 * 7/2002 Hell et al. ..... 378/141
6,709,156 B1 3/2004 Hell et al.
6,735,283 B2 * 5/2004 Kutschera et al. ..... 378/144
6,907,110 B2 * 6/2005 Apel et al. ..... 378/143
7,103,146 B2 * 9/2006 Lenz et al. ..... 378/140

FOREIGN PATENT DOCUMENTS

DE 44 29 910 A1 7/1995
DE 198 60 115 C2 11/2000
DE 100 36 210 A1 11/2001
EP 0 935 812 5/1998

* cited by examiner

*Primary Examiner*—Edward J. Glick
*Assistant Examiner*—Thomas R. Artman
(74) *Attorney, Agent, or Firm*—Schiff Hardin LLP

(57) ABSTRACT

For reducing of the weight of leakage x-ray radiation shielding for a rotary piston x-ray tube that rotates in a cooling medium in a radiator housing of an x-ray radiator, the rotary piston x-ray tube having a rotary anode and a cathode fixedly connected with the vacuum housing thereof, the vacuum housing has at least one first region of a total shielding and the radiator housing has at least a second region of the total shielding. Only the respective regions of the vacuum housing and the radiator housing has that are irradiated by the leakage x-ray radiation are provided with shielding.

16 Claims, 2 Drawing Sheets

LEAKAGE RADIATION SHIELDING ARRANGEMENT FOR A ROTARY PISTON X-RAY RADIATOR

BACKGROUND OF THE INVENTION

1. Field of the Invention

The present invention relates to rotary piston x-ray radiators, and in particular to a leakage radiation shielding arrangement for such an x-ray radiator.

2. Description of the Prior Art

Rotary piston x-ray radiators, particularly for use in medical apparatuses, must be shielded corresponding to regulatory requirements. In the known x-ray radiator described in DE 196 12 698 C1, for this purpose the radiator housing is designed as a radiation protection housing in order to shield against escaping leakage x-ray radiation, in addition to allowing the usable radiation to exit the housing that is necessary for the actual exposure of a subject to be examined. Moreover, for rotary piston x-ray radiators it is known to apply a material that significantly attenuates the x-ray radiation (such as, for example, lead) on the inside of the x-ray radiator housing in the regions to be shielded.

An x-ray radiator with a cathode arrangement and an anode arrangement rotating in a uniform vacuum chamber is known from EP 0 935 812 B1, wherein the vacuum chamber is formed by a cylindrical side wall as well as a cover and a base wall. The side wall, cover wall and base wall are fashioned from radiation-shielding materials, making the vacuum chamber relatively heavy.

SUMMARY OF THE INVENTION

An object of the present invention is to provide a rotary piston x-ray radiator of the type described above that is relatively light-weight, but that still assures a sufficient shielding against leakage x-ray radiation in a simple manner.

In accordance with the invention, this object is achieved by a rotary piston x-ray radiator wherein a first region of the shielding is located on the rotating vacuum housing of the rotary piston x-ray tube. Thus, while maintaining an ensured shielding effect, a reduction of the volume of the shielding material and therewith a reduction of the weight of the rotary piston x-ray radiator is achieved by a substantially smaller vacuum housing surface being provided with the shielding material, and being located closer to the point of origin of the x-ray radiation in comparison with the conventional situation wherein shielding is provided exclusively at surfaces of the radiator housing. This additionally means less expenditure, a smaller mechanical load, a cost savings and a more compact design for the carrier device accommodating the x-ray radiator. This in particular means a reduction of the wear of the apparatus rotation bearing given a rotary piston x-ray radiator arranged on a gantry and rotating therewith.

In order to achieve a comprehensive shielding effect with optimally little shielding material, the aforementioned region of the vacuum housing of the rotary piston x-ray radiator is located only in the region of the vacuum housing that is irradiated by the leakage x-ray radiation.

In an embodiment of the invention, the vacuum housing itself in the aforementioned region of the shielding is fashioned from a material that significantly attenuates x-ray radiation. In an embodiment of the invention that is advantageous for a simpler design of the rotary piston x-ray radiator, the region of the shielding is fashioned as a coating of the vacuum housing with a material that significantly attenuates the x-ray radiation.

The material that significantly attenuates the x-ray radiation can be tantalum and/or tungsten and/or molybdenum and/or an alloy of tantalum and/or an alloy of tungsten and/or an alloy of molybdenum.

The inventive rotary piston x-ray radiator is particularly suitable for a gantry x-ray apparatus (such as, for example, a computed tomography apparatus) and for an x-ray apparatus with a carrier device, in particular a C-arm x-ray apparatus on which the one rotary piston x-ray radiator is supported but the invention is not limited to this particular.

DESCRIPTION OF THE PREFERRED EMBODIMENTS

Figure 1:
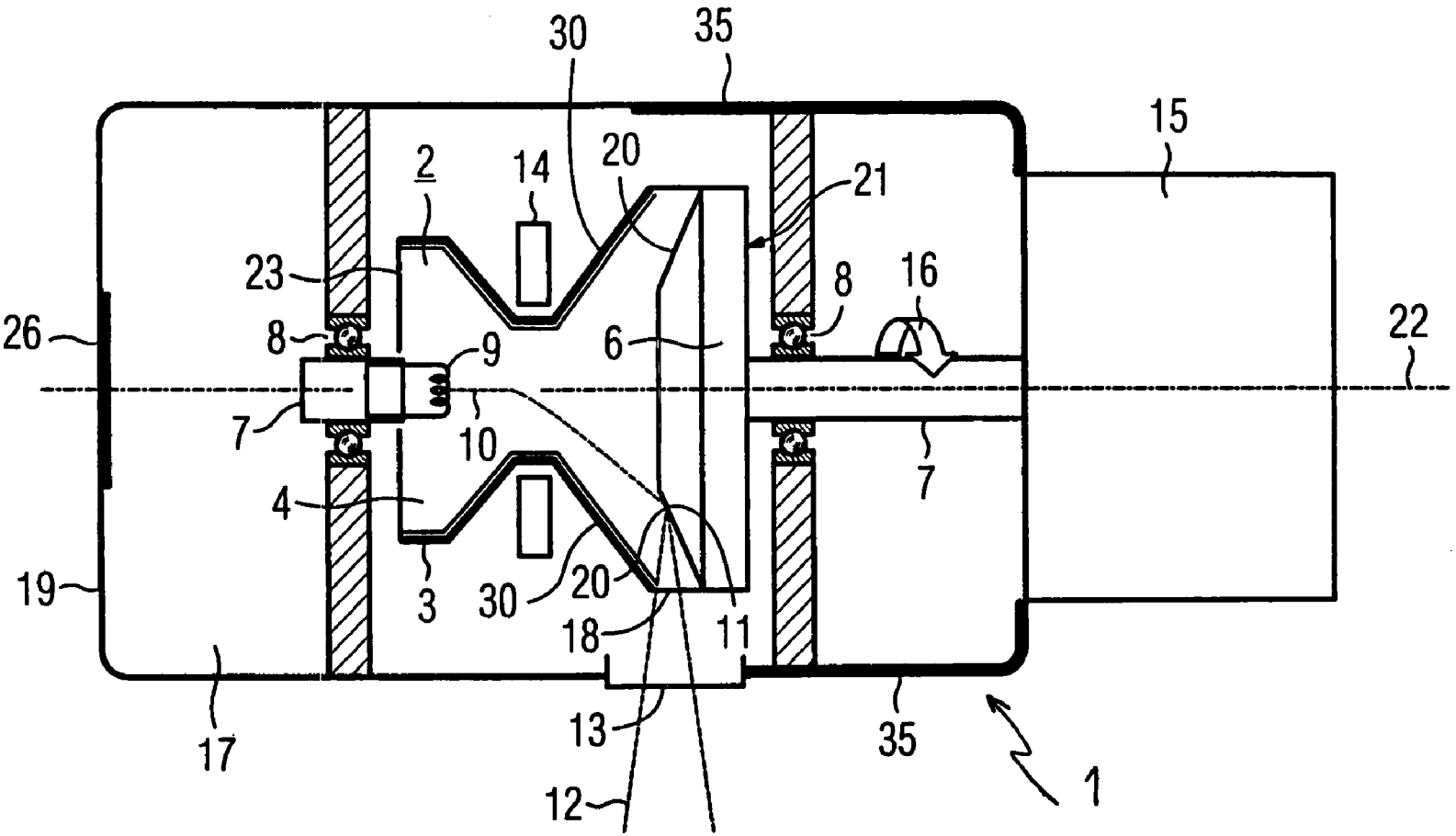
FIG. 1 shows an embodiment of a rotary piston x-ray radiator in accordance with the invention having a side wall of the vacuum housing of a rotary piston x-ray radiator with a first sub-region of a shielding and a part of the radiator housing comprises a second sub-region of the shielding.

The inventive rotary piston x-ray radiator 1 shown in FIG. 1 has a rotary piston x-ray tube 2 surrounded by an essentially rotationally-symmetrical vacuum housing 3. The rotary piston x-ray tube 2 has a vacuum 4 inside its vacuum housing 3 and is supported in a radiator housing 19 filled with a cooling medium (such as, for example, insulating oil 17) such that it can rotate on bearings via a shaft 7 around a rotation axis 22, and is driven by an actuator 15 in the rotation direction 16. A base wall of the rotary piston x-ray tube 2 is formed by a rotationally-symmetrical, plate-shaped rotary anode 6 that is permanently connected with the vacuum housing 3 and thus rotates with it. A side of the rotary anode 6 provided with a target 20 is arranged in the vacuum 4 of the vacuum housing 3 and an anode underside 21 of the rotary anode 6 is arranged in the insulating oil 17 of the radiator housing 19.

A cathode 9 that emits an electron beam 10 is located on the front side 23 of the rotary piston x-ray tube 2.1 that is opposite the rotary anode 6. The electron beam 10 is deflected by a deflection system 14 onto the target 20 of the rotary anode 6 and generates x-ray radiation at a focus 11 in the form of a usable ray 12 and in the form of leakage x-ray radiation. The usable ray 12 passes through a first usable ray exit 18 (arranged rotationally-symmetrically around the rotary piston x-ray tube 2 due to its rotation) from the rotary piston x-ray tube 2 and through a second usable ray exit 13 from the radiator housing 19.

The total shielding is formed by a shielding region 30 and a shielding region formed by a combination of shieldings 35 and 26 is for protection against the leakage x-ray radiation radiated in various directions. The total shielding is formed by the combined effect of the first region 30 on the vacuum housing 3 of the rotary piston x-ray tube 2 and the second region formed by shieldings 35 and 26 distributed on the radiator housing 19 of the rotary piston x-ray radiator 19, such that an optimal protection against escape of leakage x-ray radiation from the radiator housing 19 can be achieved with a lesser surface expenditure. In the exemplary embodiment, the first region 30 of the total shielding is arranged essentially rotationally-symmetric on the entire side wall of the vacuum housing 3 and prevents the exit of leakage x-ray radiation from the rotary piston x-ray tube 2.

According to an embodiment of the invention, the radiator housing 19 of the rotary piston x-ray radiator 1 has at least one second region of the shielding formed by shieldings 35 and 26. To optimally reduce the shielding, the radiator housing 19 of the rotary piston x-ray radiator 1 has the second region formed by the shieldings 35 and 26 only in its region irradiated by the leakage x-ray radiation. A circumferential shielding 35 of the second region the total shielding is arranged on the radiator housing 19 in order to prevent exit of leakage x-ray radiation due to the first usable ray exit 18 required in the vacuum housing 3 for the usable ray 12 and the rotation of the rotary piston x-ray tube 2 in the corresponding region. As shown in FIG. 1, due to the arrangement of the cathode 9 it is advantageous in some cases that the vacuum housing 3 of the rotary piston x-ray tube 2 is free of all of the shieldings 30, 35, 26 on its front side 23 situated opposite the rotary anode 6, since the front tube side 23 of the rotary piston x-ray tube 2 cannot be lined with a shielding material due to an insulation layer present that is at that location. Instead of this, according to an embodiment of the invention a front-side shielding 26 of the second region of the total shielding is attached on the part of the radiator housing 19 behind (viewed from the rotary anode 6) the cathode 9.

Figure 2:
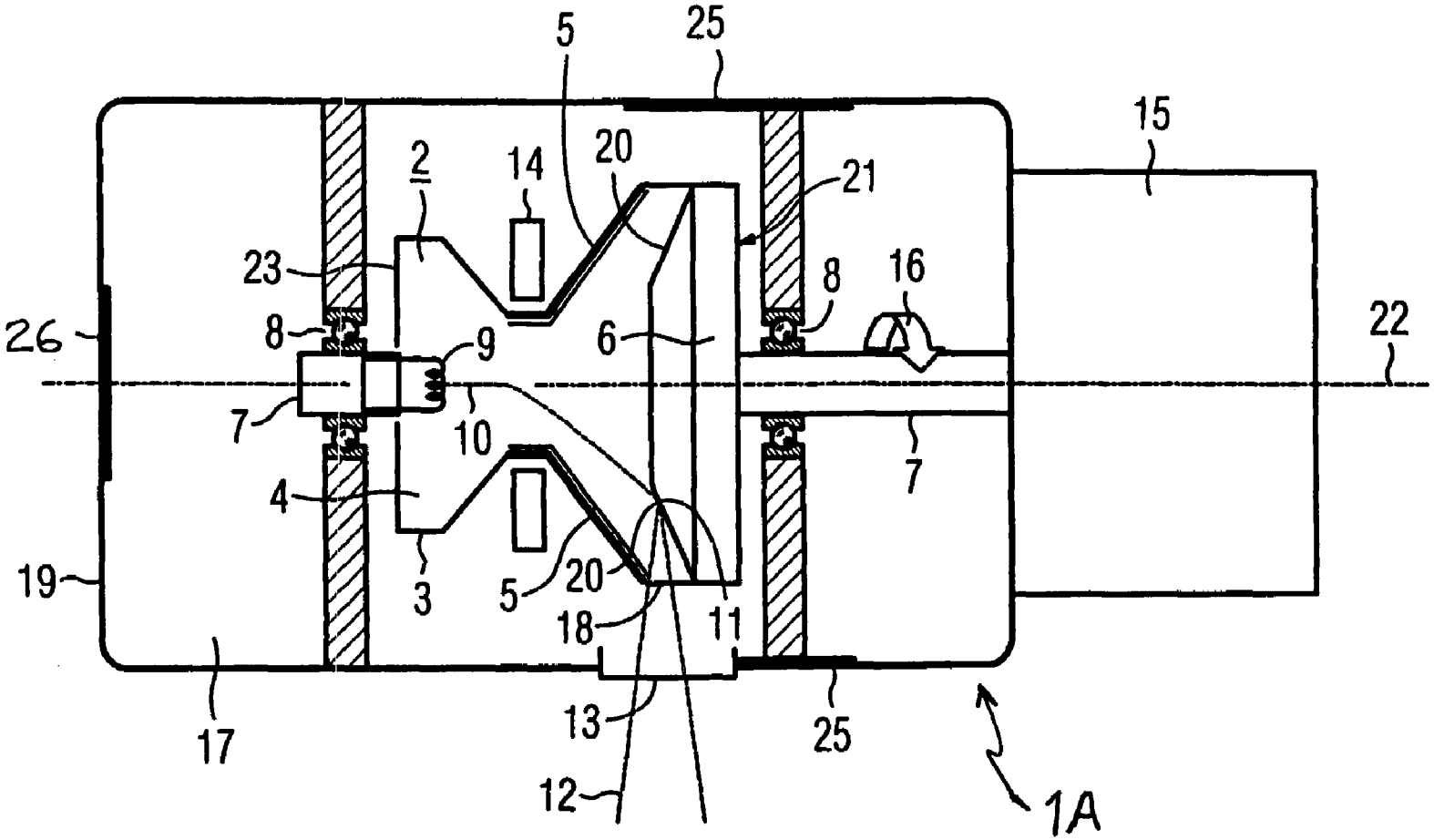
FIG. 2 shows a further embodiment rotary piston x-ray radiator in accordance with the invention, wherein a part of a side wall of the vacuum housing of the rotary piston x-ray tube forms a first region of a shielding and another part of the radiator housing forms a second region of the shielding.

A rotary piston x-ray radiator 1A with a further rotary piston x-ray tube 2 is shown in FIG. 2 as a further embodiment of the invention in which the area encompassed by the total shielding is even further reduced. In this embodiment, the vacuum housing 3 of the rotary piston x-ray tube 2 contains the first region 5 of the shielding only the portion thereof that is irradiated by the leakage x-ray radiation. A circumferential shielding 25 forms a portion of the second region of the total shielding, and is composed of a ring around the radiator housing 19 at the height of the second usable ray exit 13, with a gap for the second usable ray exit 13. An extension of the circumferential shielding to a region of the radiator housing 19 situated behind the anode underside 21 is not necessary if the rotary anode 6 itself exhibits a sufficient shielding effect. A front-side shielding 26 forms another portion of the second region of the total shielding, and is attached at the region of the radiator housing 19 situated behind (viewed from the rotary anode 6) the cathode 9.

Thus, each of the combination of the first shielding region 5 and the shieldings 25 and 26 of the second region of the total shielding, and the combination of the first shielding region 30 and the shieldings 35 and 26 of the second region of the total shielding, is fashioned such that a complete radiation protection of the rotary piston x-ray radiator 1 is ensured according to the required radiation protection regulations. The first region 5 or 30 of the total shielding shields the leakage x-ray radiation as much as possible in the region of the x-ray tube 2 that is irradiated by the leakage x-ray radiation. The second region formed by shieldings 25 and 26, or shieldings 35 and 26 is provided only for the portion of leakage x-ray radiation that can escape from the regions of the vacuum housing 3 that must be free of a shielding due to requirements such as an insulation layer for the cathode 9 or a first usable ray exit 18.

In addition to molybdenum, tantalum, tungsten and respective alloys of these materials, other good shielding materials having an atomic number above 40 in the periodic table can be used as a radiation-shielding material.

Although modifications and changes may be suggested by those skilled in the art, it is the intention of the inventors to embody within the patent warranted hereon all changes and modifications as reasonably and properly come within the scope of their contribution to the art.

We claim as our invention:

1. A rotary piston x-ray radiator comprising:

a radiator housing containing a cooling medium;

a rotary piston x-ray tube rotatably mounted in said radiator housing, said rotary piston x-ray tube comprising a vacuum housing and a rotary anode and a cathode fixedly mounted in said vacuum housing and rotated together with said vacuum housing, said vacuum housing having a first end at which said cathode is mounted and a second end at which said anode is mounted, and a narrowed neck region between said first and second ends, and a first frustrum-conical region between said first end and said neck region and a second frustrum-conical region between said neck region and said second end;

radiation shielding to prevent leakage x-ray radiation from exiting said radiator housing, said radiation shielding comprising a shielding region disposed at said vacuum housing and rotating therewith in said radiator housing, with said first end of said vacuum housing being free of said radiation shielding.

2. A rotary piston x-ray radiator as claimed in claim 1 wherein said shielding region at said vacuum housing is a first shielding region, and wherein said radiation shielding comprises a second shielding region disposed at said radiator housing.

3. A rotary piston x-ray radiator as claimed in claim 2 wherein said second shielding region is formed by material of said radiator housing that significantly attenuates x-rays.

4. A rotary piston x-ray radiator as claimed in claim 2 wherein said second shielding region is formed by a coating on said radiator housing of a material that significantly attenuates x-ray radiation.

5. A rotary piston x-ray radiator as claimed in claim 2 wherein said radiator housing has a region thereof irradiated by leakage x-ray radiation, and wherein said second shielding is disposed only at said region of said radiator housing.

6. A rotary piston x-ray radiator as claimed in claim 2 wherein said second shielding comprises an annular shielding surrounding said rotary anode of said rotary piston x-ray tube, and having a gap therein allowing a useful x-ray beam, emanating from a focus at said rotary anode, to exit said radiator housing.

7. A rotary piston x-ray radiator as claimed in claim 6 wherein said rotary anode is mounted at an end of said rotary piston x-ray tube, and wherein said radiator housing has a housing end facing said end of said rotary piston x-ray tube, and wherein said annular shielding terminates short of said end of said radiator housing.

8. A rotary piston x-ray radiator as claimed in claim 6 wherein said rotary anode is mounted at an end of said rotary piston x-ray tube, and wherein said radiator housing has a housing end facing said end of said rotary piston x-ray tube, and wherein said annular shielding covers an annular portion of said end of said radiator housing.

9. A rotary piston x-ray radiator as claimed in claim 2 wherein said rotary piston x-ray tube has an unshielded end at which said cathode is mounted, and wherein said radiator housing has a housing end facing said unshielded end of said rotary piston x-ray tube, and wherein said second shielding comprises shielding disposed at said end of said radiator housing in registration with said unshielded end of said rotary piston x-ray tube.

10. A rotary piston x-ray radiator as claimed in claim 2 wherein said second shielding is comprised of at least one material selected from the group consisting of tantalum, tungsten, molybdenum, alloys of tantalum, alloys of tungsten, and alloys of molybdenum.

11. A rotary piston x-ray radiator as claimed in claim 1 wherein said shielding is disposed at said vacuum housing only at said first frustrum-conical region, said neck region, and said second frustrum-conical region.

12. A rotary piston x-ray radiator as claimed in claim 1 wherein said shielding is disposed at said vacuum housing only at said neck region and said second frustrum-conical region.

13. A rotary piston x-ray radiator as claimed in claim 1 wherein said shielding is formed by material of said vacuum housing that significantly attenuates x-ray radiation.

14. A rotary piston x-ray radiator as claimed in claim 1 wherein said shielding is formed by a coating on said vacuum housing that significantly attenuates x-ray radiation.

15. A rotary piston x-ray radiator as claimed in claim 1 wherein said shielding is comprised of at least one material selected from the group consisting of tantalum, tungsten, molybdenum, alloys of tantalum, alloys of tungsten, and alloys of molybdenum.

16. A rotary piston x-ray radiator as claimed in claim 1 wherein said vacuum housing has a region thereof irradiated by leakage x-ray radiation, and wherein said shielding is disposed only at said region of said vacuum housing.

* * * * *